United States Patent [19]

Ishizuka

[11] Patent Number: 4,968,160

[45] Date of Patent: Nov. 6, 1990

[54] COOLING DEVICE FOR PRINTER HEAD

[75] Inventor: Yutaka Ishizuka, Konan, Japan

[73] Assignee: Diesel Kiki Co., Ltd., Tokyo, Japan

[21] Appl. No.: 272,058

[22] Filed: Nov. 14, 1988

[30] Foreign Application Priority Data

Dec. 11, 1987 [JP] Japan ..... 62-313834

[51] Int. Cl.[5] ..... B41J 29/377

[52] U.S. Cl. ..... 400/124; 400/719; 165/46

[58] Field of Search ..... 400/124 TC, 719; 101/93.05; 165/46, 47

[56] References Cited

U.S. PATENT DOCUMENTS

| | | | |
|---|---|---|---|
| 2,625,804 | 1/1953 | Patch et al. | 165/46 |
| 3,903,931 | 9/1975 | Moulin et al. | 165/46 |
| 4,196,772 | 4/1980 | Adamski et al. | 165/46 |
| 4,212,347 | 7/1980 | Eastman | 165/46 |
| 4,579,469 | 4/1986 | Falcetti | 400/124 TC |

FOREIGN PATENT DOCUMENTS

| | | | |
|---|---|---|---|
| 84681 | 6/1980 | Japan | 400/124 TC |
| 86772 | 6/1980 | Japan | 400/124 TC |
| 22070 | 2/1982 | Japan | 400/719 |

OTHER PUBLICATIONS

"Flexible Cable"; Hungarter *IBM Technical Disclosure Bulletin,* vol. 22, No. 12, p. 5303, May 1980.

*Primary Examiner*—David A. Wiecking

*Attorney, Agent, or Firm*—Wenderoth, Lind & Ponack

[57] ABSTRACT

A cooling device for a printer head includes an evaporation unit, a condenser and a refrigeration medium supply pump interconnected by conduits or tubes. The heat generated from the printer head is taken up in the form of the heat of vaporization of a refrigeration medium in the evaporation unit disposed around the printer head.

1 Claim, 2 Drawing Sheets

COOLING DEVICE FOR PRINTER HEAD

BACKGROUND OF THE INVENTION

1. Field of the Invention:

The present invention relates to a device for cooling a printer head used, for example, in dot-impact printers.

2. Description of the Related Art:

There are known various serial dot-impact printers including a printer head reciprocally movable across a paper, sheet for printing thereon a line of characters each composed of a matrix of dots. The printer head is provided with a bundle of needles or pins each corresponding to one dot and selectively projectable by the energization of an electromagnetic coil to force a portion of an ink ribbon against the paper sheet, thus printing characters on the paper sheet.

Since the temperature of the printer head is increased during a repeated energization and de-energization of the electromagnetic coils, a cooling device in the form of radiator fins is provided around the printer head for radiating heat and thus cooling the printer head by means of airstreams established around the printer head during the reciprocating motion thereof.

Such an air-cooling type of cooling device is however insufficient to radiate a great amount of heat which is produced, for instance, when all of the pins are driven by the electromagnetic coils to print boldfaced characters or when the printer head is continuously operated for a long period of time. With this insufficient heat radiation, the electromagnetic coils are likely to be damaged or broken due to overheating, resulting in an operation failure or malfunction of the printer head. Thus, the conventional air-cooled printer head has a relatively short service life.

Yet, in view of a recent tendency in the dot-impact printers toward a high-speed operation in which a great amount of heat is produced from the printer head, there is a keen demand for a cooling device which is sufficient to cool the printer head of such a high-speed printer.

SUMMARY OF THE INVENTION

It is therefore an object of the present invention to provide a cooling device for sufficiently cooling a printer head of a heavy-duty or high-speed printer.

To achieve the foregoing object, there is provided according to the present invention a device for cooling a printer head, comprising: an evaporation unit for cooling a liquid refrigeration medium to be evaporated by heat generated from the printer head; a condenser for converting the thus-evaporated refrigeration medium into a liquid state through a heat-exchange operation; a feed pump for supplying the liquid refrigeration medium to the evaporation unit; and conduit means interconnecting the feed pump, the evaporation unit and the condenser for allowing the refrigerant medium to circulate successively through the feed pump, the evaporation unit and the condenser.

With this construction, the heat generated from the printer head is taken up by the refigeration medium as the latter is converted in the evaporation unit from a liquid to a vapor. The thus vaporized refrigeration medium is fed to the condenser which in turn liquefies the vaporized refrigeration medium through a heat-exchange operation. The thus liquefied refrigeration medium is returned to the feed pump which in turn supplies the liquid refrigeration medium again to the evaporation unit. With this circulation of the refrigeration medium, the printer head is continuously cooled by means of the heat of vaporization of the refrigeration medium. Thus, a sufficient cooling of the printer head can be obtained.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

A preferred embodiment of the present invention will be described hereinbelow in detail with reference to the accompanying drawings.

Figure 3:
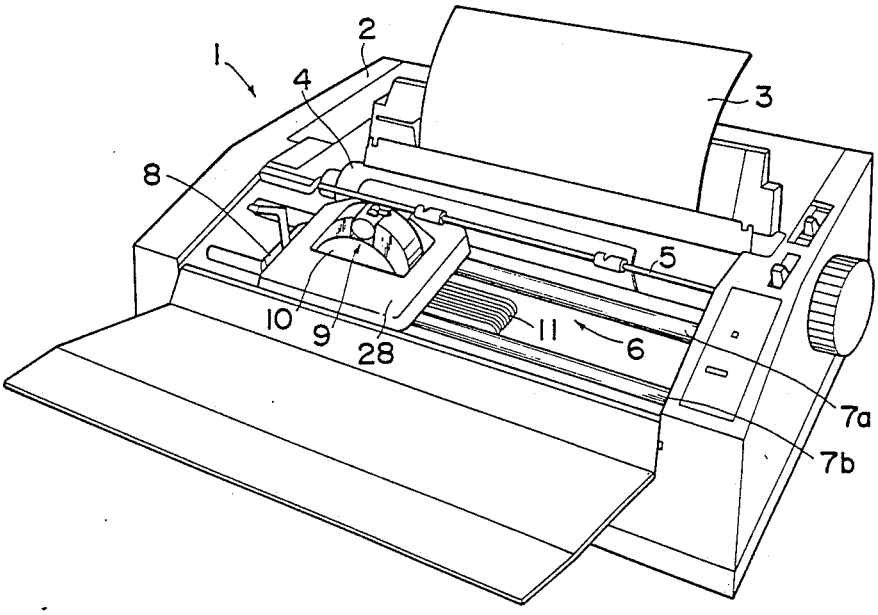
FIG. 3 is a perspective view of a printer having a printer head incorporating the cooling device shown in FIG. 1.

FIG. 3 shows a printer 1 in which a cooling device embodying the present invention is incorporated for cooling a printer head of the printer 1. The printer 1 includes a box-like frame 2 supporting thereon a platen 4 for guidingly supporting thereon the underside of a paper sheet 3, a paper bail lever 5 for pressing the paper sheet 3 against the platen 4, and a applying print to unit 6 for printing the paper sheet 3.

The printing unit 6 includes a pair of parallel spaced guide bars *7a, 7b* extending parallel to the longitudinal axis of the platen 4 for slidably supporting thereon a carrier 8 on which a printer head 9 is mounted.

The printer head 9 on the carrier 8 includes a bundle of pins or needles (not shown) projectable under the control of head control unit 10 for printing characters each composed of a matrix of dots. The head control unit 10 is disposed on the rear side of the printer head 9 and includes an electromagnetic coil assembly (not shown) constructed to drive selected ones of the needles forwardly upon energization of the corresponding portions of the electromagnetic coil assembly. The head control unit 10 is connected with a central control unit (not shown) of the printer 1 through a group of lead wires and is controlled by the central control unit. The lead wires are composed of a flexible ribbon cable 11 having one end secured to a bottom portion *2a* of the printer frame 2. The flexible ribbon cable 11 has a length long enough to allow reciprocating movement of the carrier 8 along the support bars *7a, 7b*. The head control unit 10 is surrounded by an ink ribbon cassette 28 mounted on the carrier 8.

Figure 1:
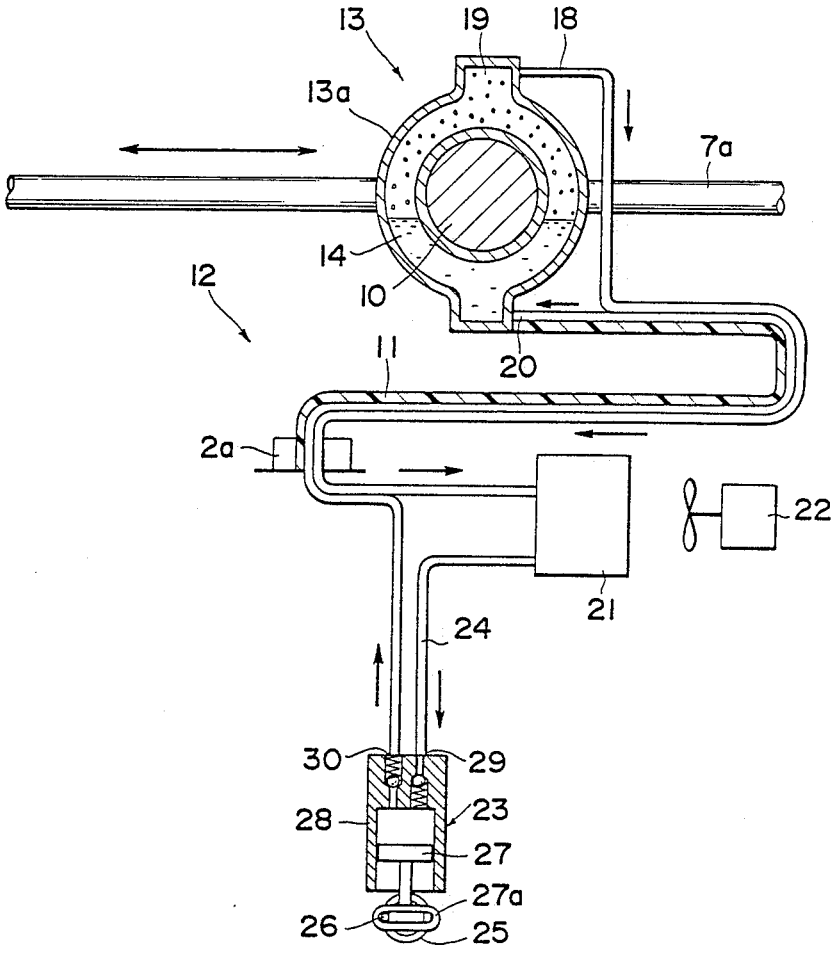
FIG. 1 is a diagrammatical view of a cooling device for a printer head according to the present invention.
Figure 2:
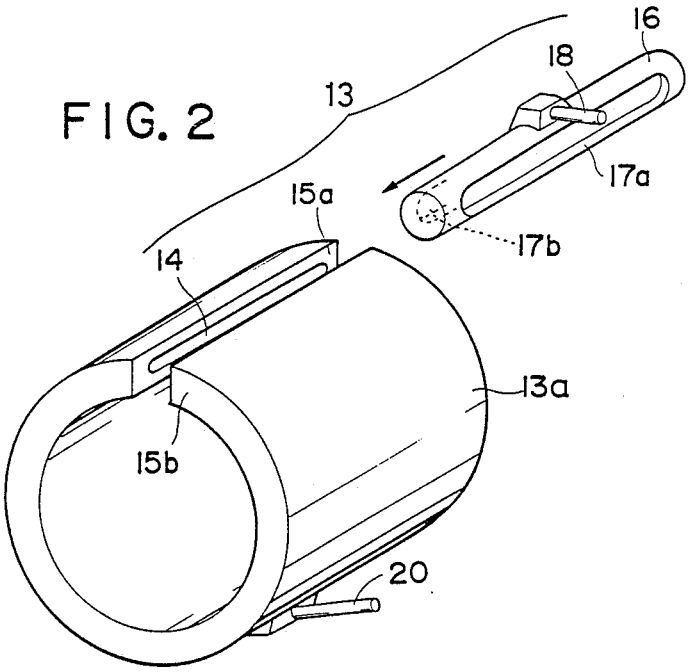
FIG. 2 is an enlarged exploded perspective view of an evaporation unit of the cooling device.

As shown in FIGS. 1 and 2, the head control unit 10 is provided with a cooling device 12 for cooling the printer head 9. The cooling device 12 comprises an evaporation unit 13 for taking up the heat from the head control unit 10, a condenser 21 for liquefying the evaporated refrigeration medium, and a feed pump 23 for supplying the thus liquefied refrigeration medium to the evaporation unit 13. All of the components 13, 21, 23 are interconnected by a conduit means for allowing the refrigeration medium to circulate through the the cooling device 12.

The evaporation unit 13 includes a flattened tube 13*a* bent into a split or interrupted ring shape extending around the head control unit 10. The interrupted ring-shaped tube 13*a* is formed from a very thermally conductive material such as copper and has an interrupted annular space 14. The opposite ends 15*a*, 15*b* of the interrupted ring-shaped tube 13*a* are connected to diametrically opposite longitudinal portions of a hollow connector tube 16. The hollow connector tube 16 is sealingly disposed between the opposite ends 15*a*, 15*b* of the tube 13*a* so as to form, jointly with the interrupted ring-shaped tube 13*a*, a continuous or uninterrupted ring with the connector tube 16 disposed on its upper side. The connector tube 16 has a pair of diametrically opposite longitudinal grooves or openings 17*a*, 17*b* connected to the annular space 14 of the tube 13*a*. The annular space 14 retains at its lower portion a liquid refrigeration medium. The connecting tube 16 has an upper portion connected to one end of an outlet conduit or tube 18 via an outlet portion 19 of the evaporation unit 13 for facilitating the delivery of the vaporized refrigeration medium from the evaporation unit 13 to the condenser 21. The lower portion of the evaporation unit 13 is connected to one end of a supply conduit or tube 20 for allowing the passage therethrough of the liquid refrigeration medium to the evaporation unit 13.

The outlet tube 18 and the supply tube 20 are formed of a flexible material such as polypropylene and they are bundled together with the flexible ribbon cable 11. The outlet tube 18 is connected at its opposite end with the condenser 21 which functions to convert the refrigeration medium from a vapor to a liquid.

The condenser 21 is subjected to a stream of air which is forced from a blower 22 to promote a heat-exchange operation of the condenser 21. The condenser 21 is connected to one end of a return conduit or tube 24, the other end of which is connected to an intake port 29 of the feed pump 23. The supply tube 20, the outlet tube 18 and the return tube 24 jointly constitute the conduit means stated above.

The feed pump 23 includes a motor 25 drivable to rotate an eccentric pin 26 along a circular path. The pin 26 is slidably received in a longitudinal groove in an elongate slider 27*a* connected to a piston 27 in a cylinder 28 at a lower side of a piston 27 which is opposite to a compression chamber of the feed pump 23 such that the circular rotary movement of the pin 26 is translated into a linear reciprocating movement of the piston 27 through the action of the pin 26 and the slider 27*a*. The cylinder 28 is provided with a pair of check valves disposed respectively at the intake port 29 and a discharge port 30 for preventing reverse flow of the refrigeration medium from the evaporation unit 13 to the feed pump 23 while the refrigeration medium is being circulated in a refrigeration system or cycle, the check valves comprising ball valves. The discharge port 30 is connected to the other end of the supply tube 20 for feeding the refrigeration medium to the evaporation unit 13.

With this construction, when the printer 1 is operated, the printer head 9 reciprocates along the guide rods 7*a*, 7*b* for printing lines of characters on the paper sheet 3.

During this printing operation, the head control unit 10 generates heat produced from the electromagnetic coil assembly mounted therein. The thus generated heat is transferred to the evaporation unit 13. In this instance, the heat transfer takes place rapidly and efficiently since the head control unit 10 is surrounded by the flattened tube 13*a* formed of copper exhibiting a high degree of thermal conductivity.

The refrigeration medium stored in the evaporation unit 13 may include water or a fluorocarbon such as 1, 1, 2-trichloro- 1, 2, 2-trifluoroethane available on the market under the tradename "Freon 113". Since the refrigeration medium retained in a liquid state in the evaporation unit 13 fills only a lower portion of the evaporation unit 13, the heat transferred to the evaporation unit 13 heats and thus urges vaporization of the refrigeration medium. Concurrently therewith, the heat is taken in the form of the heat of vaporization of the liquid refrigeration medium.

The thus vaporized refrigeration medium is then delivered through the flexible outlet tube 18 to the condenser 21 which in turn liquefies the vaporized refrigeration medium through the heat-exchange operation.

In a high-speed or heavy-duty printer, the printer head 9 is reciprocated frequently and rapidly along the rods 7*a*, 7*b* in which instance the flexible outlet and supply tubes 18, 20 follow such a rapid reciprocating movement of the printer head 9 wall.

The liquefied refrigeration medium is returned to the feed pump 23 and in turn is supplied through the supply tube 20 again to the evaporation unit 13, thus circulating the medium in the cooling device 12 for continuously cooling the printer head 9. The feed pump 23 is composed of a liquid compressor and hence is compact and highly efficient.

The boiling temperature of the refrigeration medium is easily adjustable to a desired value by regulating the pressure in the refrigeration system or cycle. With this adjustment of the boiling temperature, it is possible to maintain the temperature of the printer head below a predetermined value.

The cooling device 12 has a substantially uniform pressure distribution throughout the entire refrigeration system, therefore, the energy consumption of the feed pump is very low.

EXAMPLE

Using the printer 1 having the cooling device 12 described above, a test was made under the following conditions.

(1) Refrigeration medium: water (heat of vaporization = 539 cal/g)

(2) Pressure in the refrigeration cycle: 0.47 $Kg/cm^2$ (80° C.)

(3) Flow quantity of the liquid refrigeration medium: 0.45 cc/min (4) Inside diameter of outlet and supply tubes: 1.5 mm (5) Outside diameter of outlet and supply tubes: 2.0 mm The test results indicated an excellent cooling effect attained by the cooling device; the temperature of the electromagnetic coil assembly was not greater than 105° C. and the temperature of the heat control unit was not in excess of 90° C. The cooling capability of the cooling device was 13.42 Kcal/h.

Obviously, various modifications and variations of the present invention are possible in light of the above disclosure. It is therefore to be understood that within the scope of the appended claims the invention may be practiced otherwise than as specifically described.

What is claimed is:

1. A cooling device of a printer having a printing head controlled by a head control unit, said device comprising:

evaporator means for taking up heat from a printing head of a printer which printing head is controlled by a head control unit, said evaporator means including a generally flat tube having open ends and defining an elongate opening therein that extends between said ends, and a connector tube disposed between the ends of said generally flat tube, said generally flat tube diposed around the head control unit and containing a liquid refrigerant therein, and said connector tube having diametrically opposed openings defined therethrough and each of which diametrically opposed openings is in open communication with said elongate opening at a respective one of the ends of said generally flat tube;

condenser means operatively connected to said evaporator means for receiving refrigerant which has evaporated in said evaporator means and for converting such evaporated refrigerant into a liquid;

feed pump means operatively connected to said evaporator means and to said condenser means for receiving refrigerant converted to liquid by said condenser means and for supplying such liquid to said evaporator means; and conduit means operatively connecting said condenser means to said evaporator means and said feed pump means to both said evaporator means and said condenser means in a manner which allows refrigerant to circulate successively through said feed pump means, said evaporator means and said condenser means, said conduit means comprising a plurality of flexible tubes respectively extending between and connected tot he connector tube of said evaporator means and said condenser means, said condenser means and said feed pump means, and said feed pump means and said evaporator means.

* * * * *

UNITED STATES PATENT AND TRADEMARK OFFICE

CERTIFICATE OF CORRECTION

PATENT NO. : 4,968,160

DATED : November 6, 1990

INVENTOR(S) : Yutaka ISHIZUKA

It is certified that error appears in the above-identified patent and that said Letters Patent is hereby corrected as shown below:

Column 6, line 16;

In claim 1, line 35, "tot he" has been changed to --to the--.

Signed and Sealed this

Twelfth Day of May, 1992

*Attest:*

DOUGLAS B. COMER

*Attesting Officer*

*Acting Commissioner of Patents and Trademarks*